US007299828B2

(12) United States Patent
Liao

(10) Patent No.: US 7,299,828 B2
(45) **Date of Patent: *Nov. 27, 2007**

(54) STRETCH WOVEN FABRICS INCLUDING POLYESTER BICOMPONENT FILAMENTS

(75) Inventor: Tianyi Liao, Wilmington, DE (US)

(73) Assignee: INVISTA North America S.a r.l., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/566,321

(22) Filed: Dec. 4, 2006

(65) Prior Publication Data

US 2007/0135009 A1 Jun. 14, 2007

Related U.S. Application Data

(63) Continuation-in-part of application No. 10/718,483, filed on Nov. 20, 2003, now Pat. No. 7,143,790.

(51) Int. Cl.

| | |
|---|---|
| ***D03D 1/00*** | (2006.01) |
| ***D03D 7/00*** | (2006.01) |
| ***D03D 15/08*** | (2006.01) |
| *D03D 25/00* | (2006.01) |

(52) U.S. Cl. ..... 139/421; 139/422; 139/420 R; 139/420 A; 139/426 R

(58) Field of Classification Search ..... 139/420 R, 139/421, 422, 426 R, 420 A See application file for complete search history.

(56) References Cited

U.S. PATENT DOCUMENTS

| | | | | |
|---|---|---|---|---|
| 3,350,871 | A * | 11/1967 | Norwin et al. | 57/245 |
| 3,373,774 | A * | 3/1968 | Cruz | 139/420 R |
| 3,671,379 | A | 6/1972 | Evans et al. | |
| 6,548,429 | B2 * | 4/2003 | Lintecum et al. | 442/199 |
| 6,659,139 | B2 * | 12/2003 | Laycock et al. | 139/422 |
| 6,705,353 | B2 * | 3/2004 | Hotta et al. | 139/421 |
| 6,782,923 | B2 * | 8/2004 | Covelli | 139/440 |
| 6,803,000 | B2 * | 10/2004 | Ochi et al. | 264/103 |
| 6,841,245 | B2 * | 1/2005 | Chang et al. | 428/373 |
| 6,877,197 | B1 * | 4/2005 | Van Trump et al. | 28/247 |
| 6,974,628 | B2 * | 12/2005 | Van Trump et al. | 428/370 |
| 7,143,790 | B2 * | 12/2006 | Liao | 139/421 |
| 2003/0092339 | A1 | 5/2003 | Covelli | |

FOREIGN PATENT DOCUMENTS

| | | |
|---|---|---|
| JP | 1999 172545 A | 6/1999 |
| JP | 2001 303394 A | 10/2001 |
| JP | 2001 316923 A | 11/2001 |
| JP | 2002 004145 A | 1/2002 |
| JP | 2002 155449 | 5/2002 |
| JP | 2002 180354 | 6/2002 |
| WO | WO 0164978 A | 9/2001 |

OTHER PUBLICATIONS

International Search Report of PCT/US2004/036378.

* cited by examiner

*Primary Examiner*—Gary L. Welch
*Assistant Examiner*—Robert H Muromoto, Jr.
(74) *Attorney, Agent, or Firm*—Christina W. Geerlof; Anne I. Breikss

(57) ABSTRACT

Stretch woven fabrics including plain, twill and satin constructions are disclosed. The fabrics include weft yarns and warp yarns. Polyester bicomponent continuous filaments including poly(ethylene terephthalate) and poly(trimethylene terephthalate) having an after-heat-set crimp contraction value from about 20% to about 80% contribute to the stretch recovery properties.

16 Claims, No Drawings

STRETCH WOVEN FABRICS INCLUDING POLYESTER BICOMPONENT FILAMENTS

CROSS-REFERENCE TO RELATED APPLICATIONS

This application is a continuation-in-part of U.S. application Ser. No. 10/718,483 filed on Nov. 20, 2003, now U.S. Pat. No. 7,143,790 which is incorporated herein by reference

BACKGROUND OF THE INVENTION

1. Field of the Invention

This invention relates to woven fabrics, particularly woven fabrics including polyester bicomponent filaments of poly(ethylene terephthalate) and poly(trimethylene terephthalate) oriented in the warp direction, and optionally the weft direction of the woven fabric 2. Summary of Related Art Generally, polyester bicomponent fibers including poly (ethylene terephthalate) and poly(trimethylene terephthalate) are known. Such fibers are disclosed for example in United States Published Patent Application No. US2001/0055683, now U.S. Pat. No. 6,803,000 B2, Such fibers have been used in woven fabrics, as disclosed in United States Published Patent Application No. 2003/0092339 and in Japanese Published Patent Application Nos. JP2002-004145, JP2001-303394, JP11-172545, JP2001-316923, JP2002-180354, and JP2002-1555449. However, such fabrics can have high proportions of polyester bicomponent fibers, and fabrics that use such fibers more efficiently are sought.

SUMMARY OF THE INVENTION

The present invention relates to a warp-stretch woven fabric of a plain, twill, or satin construction. The woven fabric has weft yarns and warp yarns, and from about 15 to about 55 weight percent of the warp yarns are polyester bicomponent continuous filaments comprising poly(ethylene terephthalate) and poly(trimethylene terephthalate). The polyester bicomponent warp yarns have an after-heat-set crimp contraction value preferably of about 20% to about 80%.

DETAILED DESCRIPTION OF THE INVENTION

It has now been found that warp-stretch woven fabrics can be prepared with unexpectedly high stretch and recovery properties despite including comparatively low levels of certain polyester bicomponent yarns.

Definitions

As used herein, "polyester bicomponent filament" means a continuous filament including two different polyesters intimately adhered to each other along the length of the filament, so that the filament cross-section is for example a side-by-side, eccentric sheath-core or other suitable cross-section from which useful crimp can be developed. "Yarn" means a plurality of continuous filaments. "Pick-and-pick" means a woven construction in which a polyester bicomponent filament weft yarn ("first yarn") and a ("second") weft yarn are in alternating picks of the fabric. "Co-insertion" means a woven construction in which a polyester bicomponent filament yarn ("first yarn") and a ("second") weft yarn have been woven as one, in the same pick. "Woven separately" means the yarns are separate from each other within the finished fabric, without having been twisted or entangled together before being woven; herein "woven separately" does not preclude weaving collections of substantially similar filaments (optionally interlaced with each other) or weaving into a co-insertion construction.

As used herein, "spandex" means a manufactured filament in which the filament-forming substance is a long chain synthetic polymer including at least 85% by weight of segmented polyurethaneurea.

As used herein, "elastoester" means a manufactured filament in which the fiber forming substance is a long chain synthetic polymer composed of at least 50% by weight of aliphatic polyether and at least 35% by weight of polyester As used herein, "lastol" is a fiber of cross-linked synthetic polymer, with low but significant crystallinity. The polymer is a metallocene-based polyolefin including at least 95% by weight of ethylene and at least one other olefin unit. This fiber is elastic and substantially heat resistant.

The fabric of some embodiments is a warp-stretch woven selected from the group consisting of plain, twill, and satin constructions. The warp-stretch woven has weft yarns and warp yarns. The warp yarns may include polyester bicomponent continuous filaments including poly(ethylene terephthalate) and poly(trimethylene terephthalate) in an amount from about 5 to about 60 weight percent including from about 10 to about 60 weight percent, and from about 15 to about 55 weight percent and about 22 to about 33 weight percent. The other warp yarns can be, for example, spun staple yarns, such as cotton, wool, or linen, they can also be of monocomponent poly(ethylene terephthalate) fibers, monocomponent poly(trimethylene terephthalate) fibers, polycaprolactam fibers, poly(hexamethylene adipamide) fibers, acrylic fibers, modacrylic fibers, acetate fibers, rayon fibers, and combinations thereof.

The weft yarns can be the same as, or different from, the warp yarns. The fabric can be warp-stretch only, or it can be bi-stretch, in which useful stretch and recovery properties are exhibited in both the warp and weft directions; such weft-stretch can be provided by polyester bicomponent filament yarns, spandex, melt-spun elastomer, and the like. When the weft yarns include polyester bicomponent filament ("first") yarns, they can be present with a second yarn (optionally a spun staple yarn), for example, in a pick-and-pick or co-insertion construction.

The bicomponent filament yarns can be present in any desired amount for example from about 10 to about 30 weight percent including from about 13 to about 28 weight percent and about 13 to about 19 weight percent, based on total fabric weight when none of the polyester bicomponent filaments are present in the weft (i.e., when the polyester bicomponent filaments are only present in the warp). When bicomponent filaments are present in both the warp and the weft, the bicomponent filament yarns may be present in greater amounts, for example, from about 10 to about 60 weight percent including from about 20 to about 40 weight percent.

The polyester bicomponent filaments include poly(ethylene terephthalate) and poly(trimethylene terephthalate) in a weight ratio of about 30/70 to about 70/30, and have an after-heat-set crimp contraction value from about 20% to about 80%, preferably about 30% to about 60% Various comonomers can be incorporated into the polyesters of the bicomponent filament in minor amounts, provided such comonomers do not have an adverse effect on the amount of fiber crimp, and if the benefits of the invention are not deleteriously affected. Examples include linear, cyclic, and branched aliphatic dicarboxylic acids (and their diesters) having 4-12 carbon atoms; aromatic dicarboxylic acids (and their esters) having 8-12 carbon atoms (for example isophthalic acid, 2,6-naphthalenedicarboxylic acid, and 5-sodium-stilfoisophthalic acid); and linear, cyclic, and branched aliphatic diols having 3-8 carbon atoms (for example 1,3-propane diol, 1,2-propanediol, 1,4-butanediol, 3-methyl-1,5-pentanediol, 2,2-dimethyl-1,3-propanediol, 2-methyl-1,3-propanediol, and 1,4-cyclohexanediol). Isophthalic acid, pentanedioic acid, 5-sodium-sulfoisophthalic acid, hexanedioic acid, 1,3-propane diol, and 1,4-butanediol are preferred. The polyesters can also have incorporated therein additives, such as titanium dioxide.

The linear density of the polyester bicomponent filament yarn from which the fabrics of some embodiments are prepared can range from about 10 denier to about 900 denier, including from about 70 denier to 450 denier (11 dtex to 1000 dtex, including 78 dtex to about 500 dtex).

In some embodiments the polyester bicomponent filament yarns are not twisted or entangled combinations of bicomponent filaments with other, for example, monocomponent or staple, fibers. In other words, in these embodiments, the bicomponent filament yarns may be woven separately from the other yarns in the fabric in order to avoid the expense of an additional step, to obtain high stretch and recovery properties, and to give high fabric surface smoothness.

In other embodiments the polyester bicomponent filaments may be twisted, entangled, or core-spun with other fibers or filaments to provide additional beneficial properties. These properties include reducing exposure of the bicomponent filament, and providing different textures to the fabric. In these embodiments, a multi-component yarn may be prepared which includes polyester bicomponent filaments in addition to another fiber or filament which may be staple, continuous filament, and optionally textured fibers. These other fibers or filaments include relatively non-elastic yarns, also sometimes referred to as hard yarns such as cotton, polyester, nylon, rayon and wool, as well as elastomeric yarns such as rubber filament, bicomponent and elastoester, lastol and spandex.

Multi-component yarns may also include covered yarns where one fiber is surrounded by, twisted with, or intermingled with another fiber or yarn. Covered yarns that include elastomeric fibers and hard yarns are also termed "composite yarns." When an elastomeric fiber is used, the hard-yarn covering serves to protect the elastomeric fibers from abrasion during weaving processes. Such abrasion can result in breaks in the elastomeric fiber with consequential process interruptions and undesired fabric non-uniformities Further, the covering helps to stabilize the elastomeric fiber elastic behavior, so that the composite yarn elongation can be more uniformly controlled during weaving processes than would be possible with bare elastomeric fibers.

There are multiple types of composite yarns, including: (a) single wrapping of the one fiber with a different fiber; (b) double wrapping of one fiber with another fiber, (c) continuously covering (i.e., core spinning) one fiber with staple fibers, followed by twisting during winding; (d) intermingling and entangling two or more fibers with an air jet, and (e) twisting two or more different fibers or yarns together One example of a composite yarn is a corespun yarn A "corespun yarn" consists of a separable core surrounded by a spun fiber sheath. Elastomeric corespun yarns are produced by introducing an elastomeric filament to the front drafting roller of a spinning frame where it is covered by staple fibers.

Many combinations of bicomponent polyester with elastomeric and/or hard yarns may be included. For example, bicomponent polyester filament may be combined with one or more hard yarns without an additional elastomeric fiber. Alternatively, bicomponent polyester may be combined with one or more elastomeric fibers, and also optionally one or more hard yarns The elastomeric filaments may be present in an amount from zero up to about 50% by weight of either the warp or weft yarns, including from about 1% to about 10% by weight.

In the embodiments including an additional elastomeric fiber, a smaller weight percentage of bicomponent polyester will be necessary to achieve the desired stretch recovery properties for fabrics including these multi-component yarns. Suitable fabrics may include multi-component yarns having bicomponent filament and one or more elastomeric filaments. In these multi-component yarn containing fabrics, polyester bicomponent filament may be present from about 1% by weight up to about 60% by weight, including about 3% by weight to about 55% by weight, about 5% to about 33% by weight, about 5% by weight to about 25% by weight, and about 10% by weight to about 25% by weight based on the weight of the warp yarns. For a fabric including multi-component yarns including polyester bicomponent, the polyester bicomponent filaments may be present in an amount from about 0.5% by weight to about 50% by weight, including 1% by weight to about 35% by weight, about 5% by weight to about 28% by weight, about 13 to about 28% by weight, about 13% to about 19%, by weight, and about 8% by weight to about 20% by weight, based on the total fabric weight (this includes when the bicomponent polyester filaments are present only in the warp or in the warp and the weft.)

In some embodiments, a maximum of about 3 wt % of a resin or similar material be in or affixed to the fabric, because such resin treatment can add expense, and the benefits of the invention are achieved without incurring this expense. Another benefit of the invention is that the polyesters in the bicomponent filaments need not be partially removed from the fabric by chemical means, for example, by application of a chemical treatment such as a highly alkaline solution. While such resin and chemical treatments might still be used in conjunction with the invention, we believe that stretch and recovery properties of the woven fabric may be compromised, and thus prefer to eliminate such added steps. However, additional materials such as resins may be added in any desired amount to achieve additional benefits.

The fabric of some embodiments can be of plain, twill, or satin construction Examples of useful twill constructions include regular twills (for example, 2/1, 1/2, 1/3, and 2/2 twills), modified twills (in which additional lifts have been added to the weaving plan), herringbone, and pointed twills Examples of useful satin constructions include 5-end (for example 1/5 and 2/5) and 8-end (for example 3/8) weaves The fabrics of some embodiments are useful for a variety of end uses. These including garments and clothing such as pants, shirtings, and jackets including denim pants or jeans and jackets as well as for furniture.

Loom types that can be used to make woven fabrics include air-jet looms, shuttle looms, water-jet looms, rapier looms, and gripper (projectile) looms.

Before being tested, fabrics and fibers were conditioned for 16 hours at 21° C. +/−1° C. and 65% +/−2% relative humidity.

After-heat-set contraction values were measured as follows. A sample of the bicomponent polyester filament to be used was formed into a skein of 5000+/−5 total denier (5550 dtex) with a skein reel at a tension of about 0.1 gpd (0.09 dN/tex). The skein was conditioned at 70+/−2° F. (21+/−1° C.) and 65+/−2% relative humidity for a minimum of 16 hours. The skein was hung substantially vertically from a stand, a 1.5 mg/den (1.35 mg/dtex) weight (e.g. 7.5 g for a 5550 dtex skein) was hung on the bottom of the skein, the weighted skein was allowed to come to an equilibrium length, and the length of the skein was measured to within 1 mm and recorded as "Cb" The 1.35 mg/dtex weight was left on the skein for the duration of the test. Next, a 500 g weight (100 mg/d; 90 mg/dtex) was hung from the bottom of the skein, and the length of the skein was measured to within 1 mm and recorded as "Lb". Crimp contraction value (percent) (before heat-setting, as described below for this test), "CCb", was calculated according to the formula $$CCb=100\times(Lb-Cb)/Lb$$

The 500 g weight was removed and the skein was then hung on a rack and heat-set, with the 1.35 mg/dtex weight still in place, in an oven for 5 minutes at about 225° F. (107° C.), after which the rack and skein were removed from the oven and conditioned as above for two hours. This step is designed to simulate commercial dry heat-setting, which is one way to develop the final crimp in the bicomponent fiber. The length of the skein was measured as above, and its length was recorded as "Ca". The 500 g weight was again hung from the skein, and the skein length was measured as above and recorded as "La". The after heat-set crimp contraction value (%), "CCa", was calculated according to the formula $$CCa=100\times(La-Ca)/La$$

In the Examples, unless otherwise noted, a Dornier rapier loom was used at 500 picks per minute to make plain wovens with 55 picks per inch (22 picks/cm) and 1/3 twills with 62 picks per inch (24 picks/cm) in the loomstate. The yarn of poly(ethylene terephthalate) and poly(trimethylene terephthalate) ("bicomponent polyester yarn") was 150 denier (167 dtex), 34 filament T-400™ Elasterell-p, available from Invista Sarl, Wilmington, Del. The polyester bicomponent filament was 40 wt % poly(ethylene terephthalate) and 60 wt % poly(trimethylene terephthalate) and had an after-heat-set crimp contraction value of 47%. Before beaming, bicomponent fiber yarns to be used in the warp were sized at 300 yards/minute (274 m/min) with a poly (vinyl alcohol) size using a Suziki single end sizing machine in which the temperature in the sizing bath was set at 107° F. (42° C.). The sized yarn was dried at 190° F. (88° C.) for about 5 minutes. The fill yarn was ring-spun cotton of 30 cotton count. Poly(ethylene terephthalate) yarn ("monocomponent polyester yarn"), when used, was a textured and interlaced 150 denier (167 dtex), 50 filament yarn produced by Unifi, Inc.

Each greige fabric was finished by passing it under low tension through hot water three times at 160° F., 180° F. and 202° F. (71° C., 82 vC, and 94° C., respectively); then de-sizing/pre-scouring it with 6 wt % Synthazyme® (a starch-hydrolyzing enzyme from Dooley Chemicals LLC), 1 wt % Lubit® 64 (a nonionic lubricant from Sybron, Inc.), and 0.5 wt % Merpol® LFH (a surfactant and registered trademark of E. I. du Pont de Nemours and Company) at 160° F. (71° C.) for 30 minutes, followed by addition of 0.5 wt % trisodium phosphate. The fabric was then scoured with 1 wt % Lubit® 64 and 1 wt % Merpol® LFH at 110° F. (43° C.) for 5 minutes, jet-dyed with a yellow disperse dye (and a yellow reactive dye when cotton was present in the fabric) at 230° F. (110° C.) for 30 min at pH 5.2, and then heat-set on a tenter frame at 340° F. (171° C.) for 40 sec while being underfed in the warp direction (Weight percents for finishing components are based on fabric weight.)

The Percent Available Stretch of the fabrics in the Examples was measured as follows. Three 60×6.5 cm sample specimens were cut from each fabric. The long dimension corresponded to the warp direction. Each specimen was unraveled equally on each side until it was 5 cm wide. One end of the fabric was folded to form a loop, and a seam was sewn across the width to fix the loop. At 6.5 cm from the unlooped end of the fabric a first line was drawn, and 50 cm away ("GL") from the first line, a second line was drawn The sample was conditioned for at least 16 hours at 20+/−2° C. and 65+/−2% relative humidity. The sample was then clamped at the first line and hung vertically. A 30 newton weight was hung from the loop, and the sample was exercised 3 times by alternately allowing it to be stretched by the weight for 3 seconds and then supporting the weight so the fabric was unloaded. The weight was re-applied, and the distance between the lines ("ML") was recorded to the nearest millimeter. Percent Available Stretch was calculated from Formula I, $$\%\ \text{Available Stretch}=100\times(ML-GL)/GL \quad \text{(I)}$$

and the results from the three specimens were averaged

The Percent Recovery of the fabrics in the Examples was calculated as 100% minus Percent Fabric Growth (% Fabric Growth), which was measured as follows. Three new specimens were prepared as described for the Available Stretch test, extended to 80% of the previously determined Available Stretch, and held in the extended condition for 30 minutes. They were then allowed to relax without restraint for 60 minutes, and the length ("L2") between the lines was again measured. Percent Fabric Growth was calculated from Formula II, $$\%\ \text{Fabric Growth}=100\times(L2-GL)/GL \quad \text{(II)}$$

and the results from the three specimens were averaged.

In describing warp yarn repeating patterns in the fabric constructions of the Examples, "bi" means bicomponent and "mono" means monocomponent. The repeating patterns used were those that were most uniform for the weight percent of bicomponent filament warp yarns present. For example, when the bicomponent filament yarns were at a 50 weight percent level, the repeating pattern was bi/mono/bi/mono rather than bi/bi/mono/mono, and when the bicomponent filament yarns were present at a 33 weight percent level in the warp, the repeating pattern was bi/mono/mono/bi/mono/mono rather than bi/bi/mono/mono/mono/mono. Although using most uniform repeating patterns for obtaining high fabric uniformity in surface appearance, stretch, and recovery, such patterns are not required.

Available Stretch ("Stretch") and "Recovery" properties of the fabrics made in the Examples are presented in Tables I (plain wovens) and II (twills). For clarity, the yarns used in the Examples had the same linear density, so that warp end percent is equal to warp weight percent. In the Tables, "Bicomponent weight percent" is based on total warp weight. "Stretch per bicomponent wt %" and "Recovery per bicomponent wt %" refers to the relative amount of bicomponent polyester yarn in the warp only.

The features and advantages of the present invention are more fully shown by the following examples which are provided for purposes of illustration, and are not to be construed as limiting the invention in any way.

EXAMPLES

Example 1

A plain woven fabric was made in which the warp had a 1:1 end ratio (50/50 weight ratio) of bicomponent polyester yarn to monocomponent polyester yarn, arranged alternately at 86 ends/inch (34 ends/cm) in the loom state. The fabric was 80 inches (203 cm) wide on the loom and 78 inches (198 cm) wide off the loom in the greige state After dyeing and finishing, the fabric had yarn densities of 100 ends/inch (39 ends/cm) and 96 picks/inch (38 picks/cm), weighed 4.86 oz/yd2 (165 g/m2), and contained 28 wt % bicomponent polyester yarn, based on total fabric weight.

Example 2

A plain woven fabric was made in which the warp had a 1.2 end ratio (33/67 weight ratio) of bicomponent polyester yarn to monocomponent polyester yarn, arranged in a bi/mono/mono repeating pattern at 86 ends/inch (34 ends/cm) in the loom state. The fabric was 80 inches (203 cm) wide on the loom and 78 inches (198 cm) wide off the loom in the greige state. After dyeing and finishing, the fabric had yarn densities of 90 ends/in (35 ends/cm) and 97 picks/in (38 ends/in), weighed 4.49 oz/yd2 (152 g/m2), and contained 19 wt % bicomponent polyester yarn, based on total fabric weight.

Example 3

A plain woven fabric was made in which the warp had a 1:3 end ratio (25/75 weight ratio) of bicomponent polyester yarn to monocomponent polyester yarn, arranged in a bi/mono/mono/mono repeating pattern at 86 ends/inch (34 ends/cm) in the loom state. The fabric was 80 inches (203 cm) wide on the loom and 78 inches (198 cm) wide off the loom in the greige state. After dyeing and finishing, the fabric had yarn densities of 100 ends/in (39 ends/cm) and 95 picks/inch (37 picks/cm), weighed 4.55 oz/yd2 (154 g/m2), and contained 14 wt % bicomponent polyester yarn, based on total fabric weight.

Example 4

A twill fabric was made in which the warp had a 1:1 end ratio (50/50 weight ratio) of bicomponent polyester yarn to monocomponent polyester yarn, arranged alternately at 86 ends/inch (34 ends/cm) in the loom state. The fabric was 80 inches (203 cm) wide on the loom and 75 inches (190 cm) wide in the greige state. After dyeing and finishing, the fabric had yarn densities of 104 ends/inch (41 ends/cm) and 88 picks/inch (35 picks/cm), weighed 5.47 oz/yd2 (185 g/m2), and contained 27 wt % bicomponent polyester yarn, based on total fabric weight.

Example 5

A twill fabric was woven in which the warp had a 1.2 end ratio (33/67 weight ratio) of bicomponent polyester yarn to monocomponent polyester yarn, arranged in a bi/mono/mono repeating pattern at 86 ends/inch (34 ends/cm) in the loom state. The fabric was 80 inches (203 cm) wide on the loom and 75 inches (190 cm) wide in the greige state After dyeing and finishing, the fabric had yarn densities of 90 ends/inch (35 ends/cm) and 92 picks/inch (36 picks/cm), weighed 4.92 oz/yd2 (167 g/m2), and contained 18 wt % bicomponent polyester yarn, based on total fabric weight.

Example 6

A twill fabric was made in which the warp had a 1:3 end ratio (25/75 weight ratio) of bicomponent polyester yarn to monocomponent polyester yarn, arranged in a bi/mono/mono/mono repeating pattern at 86 ends/inch (34 ends/cm) in the loom state. The fabric was 80 inches (203 cm) wide on the loom and 78 inches (198 cm) wide in the greige state. After dyeing and finishing, the fabric had yarn densities of 100 ends/inch (39 ends/cm) and 107 picks/inch (42 picks/cm), weighed 5.67 oz/yd2 (192 g/m2), and contained 13 wt % bicomponent polyester yarn, based on total fabric weight.

Example 7

A plain woven fabric was made in which the warp had a 1:1 end ratio (50/50 weight ratio) of bicomponent polyester yarn to sized 30 cotton count ring-spun cotton, arranged alternately at 86 ends/inch (34 ends/cm) in the loom state. The fabric was 80 inches (203 cm) wide on the loom and 78 inches (198 cm) wide in the greige state. After dyeing and finishing, the gray fabric had yarn densities of 88 ends/inch (35 ends/cm) and 98 picks/inch (39 picks/cm), weighed 4.78 oz/yd2 (162 g/m2), and contained 28 wt % bicomponent polyester yarn, based on total fabric weight.

Example 8

A twill fabric was made in which the warp had a 1:2 end ratio (33/67 weight ratio) of bicomponent polyester yarn to monocomponent polyester yarn, arranged in a bi/mono/mono repeating pattern at 86 ends/inch (34 ends/cm) in the loom state. The weft yarn was monocomponent polyester yarn The fabric was 80 inches (203 cm) wide on the loom and 75 inches (190 cm) wide in the greige state. After dyeing and finishing, the fabric had yarn densities of 120 ends/inch (47 ends/cm) and 90 picks/inch (35 picks/cm), weighed 5.85 oz/yd2 (198 g/m2), and contained 18 wt % bicomponent polyester yarn, based on total fabric weight.

Example 9

A plain woven fabric was made in which the warp had a 1:1 end ratio (50/50 weight ratio) of bicomponent polyester yarn to monocomponent polyester yarn, arranged alternately at 86 ends/inch (34 ends/cm) in the loom state. The weft yarn was entirely of bicomponent polyester yarn. The fabric was 80 inches (203 cm) wide on the loom and 76 inches (193 cm) wide in the greige state. After dyeing and finishing, the fabric had available stretch in the warp and weft directions of 26% and 25%, respectively, and yarn densities of 112 ends/inch (44 ends/cm) and 95 picks/inch (37 picks/cm). The weight of the fabric was 5.8 oz/yd2 (197 g/m2), and it contained 72 wt % bicomponent polyester yarn, based on total fabric weight.

Example 10

A twill fabric was woven in which the warp had a 1:1 end ratio (50/50 weight ratio) of bicomponent polyester yarn to monocomponent polyester yarn, arranged alternately at 86 ends/inch (34 ends/cm) in the loom state. The weft yarns were bicomponent polyester yarn and 30 cotton count ring-spun cotton, woven pick-and-pick. The fabric was 80 inches (203 cm) wide on the loom and 76 inches (193 cm) wide in the greige state. After dyeing and finishing, the fabric had available stretch of 50% and 17% in the warp and weft directions, respectively, and yarn densities of 115 ends/inch (45 ends/cm) and 90 picks/inch (35 picks/cm). The fabric weighed 6.44 oz/yd2 (218 g/m2), and it contained 50 wt % bicomponent polyester yarn, based on total fabric weight.

Example 11

A plain woven fabric was made in which the warp had a 1:1 end ratio (50/50 weight ratio) of bicomponent polyester yarn to monocomponent polyester yarn, arranged alternately at 86 ends/inch (34 ends/cm) in the loom state. The weft yarns were bicomponent polyester yarn and monocomponent polyester yarn, woven pick-and-pick. The fabric was 80 inches (203 cm) wide on the loom and 75 inches (190 cm) wide in the greige state. After dyeing and finishing, the fabric had 31% and 18% available stretch in the warp and weft directions, respectively, and yarn densities of 94 ends/inch (37 ends/cm) and 102 picks/inch (40 picks/cm). The fabric weighed 5.64 oz/yd2 (191 g/m2), and it contained 50 wt % bicomponent polyester yarn, based on total fabric weight.

Example 12 (Comparison)

A plain woven fabric was made in which the warp was entirely bicomponent polyester yarn; that is, the end ratio was 1:0. The weft yarn was 30 cc ring-spun cotton. A Ruti air-jet loom was used at 500 picks per minute. On the loom, the yarn counts were 70 ends/inch (28 ends/cm) and 50 picks/inch (20 picks/cm). The fabric was 67 inches (170 cm) wide on the loom and 65 inches (165 cm) in the greige state. After dyeing and finishing, the fabric had a weight of 3.47 oz/yd2 (118 g/m2) and yarn densities of 74 ends/inch (29 ends/cm) and 72 picks/inch (28 picks/cm), and it contained 54 wt % bicomponent polyester yarn, based on total fabric weight.

The data in Tables I and II show that unexpectedly and disproportionately (compared to their bicomponent filament yarn content) high stretch and recovery properties are exhibited by the fabrics of the invention. The designation "nm" indicates a value was "not measured".

While there have been described what are presently believed to be the preferred embodiments of the invention, those skilled in the art will realize that changes and modifications may be made thereto without departing from the spirit of the invention, and it is intended to include all such changes and modifications as fall within the true scope of the invention

What is claimed is:

1. A fabric comprising:

a woven fabric selected from the group consisting of plain, twill and satin construction, comprising:

a plurality of weft yarns and a plurality of warp yarns, wherein from about 15 to about 55 weight percent of the warp yarns are polyester bicomponent continuous filaments comprising poly(ethylene terephthalate) and poly(trimethylene terephthalate) and having an after-heat-set crimp contraction value from about 20% to about 80%, and polyester bicomponent continuous filaments are present in both the warp yarns and the weft yarns.

2. A fabric comprising:

a woven fabric selected from the group consisting of plain, twill and satin construction, comprising:

a plurality of weft yarns and a plurality of warp yarns, wherein from about 5 to about 60 weight percent of the fabric weight comprises polyester bicomponent continuous filaments comprising poly(ethylene terephthalate) and poly(trimethylene terephthalate) and having an after-heat-set crimp contraction value from about 20% to about 80%.

3. The fabric of claim 2, wherein said fabric comprises polyester bicomponent continuous filaments from about 20 to about 40 weight percent of the fabric weight.

TABLE I

| Example | End ratio | Warp Bicomponent Weight % | Fabric Stretch, % | Stretch per warp bicomponent wt % | Fabric Recovery, % | Recovery per warp bicomponent wt % |
|---|---|---|---|---|---|---|
| 1 | 1:1 | 50 | 34 | 0.7 | 98 | 2.0 |
| 2 | 1:2 | 33 | 23 | 0.7 | 98 | 3.0 |
| 3 | 1:3 | 25 | 25 | 1.0 | 99 | 4.0 |
| 7 | 1:1 | 50 | 36 | 0.7 | Nm | nm |
| 9 | 1:1 | 50 | 26 | 0.5 | Nm | nm |
| 11 | 1:1 | 50 | 31 | 0.6 | Nm | nm |
| 12 (Comp.) | 1:0 | 100 | 30 | 0.3 | 99 | 1.0 |

TABLE II

| Example | End ratio | Warp Bicomponent Weight % | Fabric Stretch, % | Stretch per warp bicomponent wt % | Fabric Recovery, % | Recovery per warp bicomponent wt % |
|---|---|---|---|---|---|---|
| 4 | 1:1 | 50 | 43 | 0.9 | 97 | 1.9 |
| 10 | 1:1 | 50 | 50 | 1.0 | Nm | nm |
| 5 | 1:2 | 33 | 28 | 0.8 | 99 | 3.0 |
| 8 | 1:2 | 33 | 23 | 0.7 | Nm | nm |
| 6 | 1:3 | 25 | 27 | 1.1 | 98 | 3.9 |

4. The fabric of claim 2, wherein both of said weft yarns and said warp yarns comprise polyester bicomponent continuous filaments.

5. The fabric of claim 2, wherein from about 15 to about 55 weight percent of the warp yarns are polyester bicomponent continuous filaments.

6. The fabric according to claim 2, wherein from about 22 to about 33 weight percent of the warp yarns are polyester bicomponent continuous filaments.

7. The fabric of claim 2, comprising from about 13 weight percent to about 19 weight percent polyester bicomponent yarns, based on total fabric weight.

8. A fabric comprising:

a woven fabric comprising a plurality of weft yarns and a plurality of warp yarns, wherein said warp yarns and optionally said weft yarns comprise about 15 to about 55 weight percent polyester bicomponent continuous filament in the form of a corespun multi-component yarn; said polyester bicomponent filament comprising poly(ethylene terephthalate) and poly(trimethylene terephthalate).

9. The fabric of claim 8, wherein said polyester continuous filament has an after-heat-set crimp contraction value from about 20% to about 80%.

10. The fabric of claim 8, wherein both said warp yarns and said weft yarns comprise bicomponent polyester continuous filaments.

11. An article comprising a garment;

said garment comprising a woven fabric comprising a plurality of weft yarns and a plurality of warp yarns, wherein said warp yarns and optionally said weft yarns comprise about 15 to about 55 weight percent bicomponent polyester continuous filament in the form of a corespun multi-component yarn; said polyester bicomponent filament comprising poly(ethylene terephthalate) and poly(trimethylene terephthalate).

12. The garment of claim 11, wherein said garment comprises denim jeans.

13. A fabric comprising:

a woven fabric comprising a plurality of weft yarns and a plurality of warp yarns, wherein the warp yarns and optionally the weft yarns comprise at least one elastomeric filament and at least one polyester bicomponent continuous filament, wherein said polyester bicomponent continuous filament is present in an amount of from about 1% by weight to about 55% by weight of said warp yarns and optionally said weft yarns, independently; said polyester bicomponent filament comprising poly(ethylene terephthalate) and poly(trimethylene terephthalate).

14. The fabric of claim 13, wherein both said warp yarns and said weft yarns comprise from about 1% to about 55% by weight polyester bicomponent continuous filaments.

15. The fabric of claim 13, wherein said warp yarns and said weft yarns comprise from about 5% to about 20% by weight polyester bicomponent continuous filaments.

16. The fabric of claim 13, wherein both said warp yarns and said weft yarns comprise at least one elastomeric filament.

* * * * *